United States Patent [19]

Zorini

[11] Patent Number: 4,876,862

[45] Date of Patent: Oct. 31, 1989

[54] CONTROL DEVICE FOR THREADING TUBES IN CROCHET GALLOON LOOMS

[75] Inventor: Luigi O. Zorini, Cilavegna, Italy

[73] Assignee: Comez S.P.A., Cilavegna, Italy

[21] Appl. No.: 221,128

[22] Filed: Jul. 19, 1988

[30] Foreign Application Priority Data

Jul. 21, 1987 [IT] Italy ..... 22047/87[U]

[51] Int. Cl.[4] ..... D04B 23/00

[52] U.S. Cl. ..... 66/207

[58] Field of Search ..... 66/204, 205, 207

[56] References Cited

U.S. PATENT DOCUMENTS 4,549,414 10/1985 Zorini et al. ..... 66/207 X 4,590,776 5/1986 Bonaschi ..... 66/207 X

*Primary Examiner*—Ronald Feldbaum

*Attorney, Agent, or Firm*—Laff, Whitesel, Conte & Saret

[57] ABSTRACT

The device comprises a number of threading tubes 2 oscillatably mounted on a thread guide rail 5 provided with an oscillatory motion. Each theading tube 2 is movable against the action of a first return spring 6, upon command of an actuation cable 9 guided within a sheath 10 and connected to a control plate 19 selectively operable in synchronism with the thread guide rail 5. Each sheath 10 has one end 10*a* which is fixed with respect to the thread guide rail 5 and a second end 10*b* connected to a fixed support 11, a second return spring 15 being interposed therebetween, the stiffness of said second spring 15 being greater than that of the first return spring 6. A preloading plate 17fastened to the fixed support 11 acts upon locating elements 13 in order to keep said second return springs in a preloading condition.

3 Claims, 3 Drawing Sheets

16a
10b
9
10
13
13a
17
11
18
14
15
16
19
20
9b
21
25

CONTROL DEVICE FOR THREADING TUBES IN CROCHET GALLOON LOOMS

BACKGROUND OF THE INVENTION

1. Field of the Invention

The present invention relates to a control device for threading tubes in crochet galloon looms of the type comprising a thread guide rail provided with an oscillatory motion, a number of threading tubes oscillatory supported by the thread guide rail and individually translatable with respect to said rail against the action exerted by respective first return springs, a number of actuation cables each of them having one end connected to one of said threading tubes, a number of sheaths each slidably engaging one of said actuation cables and having one end fixedly fastened with respect to the thread guide rail and the second end engaged with a fixed support, a number of control plates each engaging at least one of said actuation cables at a second end thereof and being provided with a to-and-fro translation movement with respect to said fixed support in order to cause, through said actuation cables, the translations of said threading tubes against the action of said first return springs, and control means to selectively translate the control plates in synchronism with the movements of said thread guide rail.

2. Prior Art

It is known that there are knitting machines consisting of the association of a crochet galloon loom with a jacquard device. The jacquard device has the function of controlling the movements of the weft yarns in order to enable the formation of very elaborate figured fabrics.

In greater detail, the weft yarns are individually engaged by respective threading tubes oscillatably supported by a thread guide rail provided with combined horizontal and vertical oscillatory motions in synchronism with the movements of the needles. The jacquard device comprises actuation means which, through actuation cables slidably guided within respective sheaths, substantially acts so as to selectively control the positioning, at each working cycle, of the individual threading tubes with respect to the corresponding needles in order to cause the weft yarns to be suitably engaged or not by the needles.

The displacements of each threading tube take place against the action of a first return spring having the function of bringing the tube back to its starting position once the pulling action on the actuation cable has ceased. Also interposed between each actuation cable and the respective threading tube is a second return spring which is stiffer than the first spring and is designed to undergo elastic deformation when the actuation cable, fixedly secured to the selective tensioning means, is still translated within the sheath, after the threading tube has reached its stop position at the end of the stroke. The additional translation of the cable, usually referred to as "extra stroke" represents a useful expedient because it is thus no longer necessary to carry out hard setting ups of the tensioning means and cables for the purpose of being sure that each threading tube is brought to its stop position when its translation is commanded.

In the known art problems have been encountered due to the quick wear of sheaths above all when said sheaths and the corresponding actuation cables have a curved longitudinal extension. This situation for example occurs in knitting machines recently studied and produced by the same applicant, in which the jacquard device is disposed alongside the loom instead of being in superposed relationship with the loom, which happens in traditional knitting machines.

The quick wear of sheaths is due to the sliding friction of the cables in the sheaths, which friction becomes very important as a result of many factors which can be summarized as follows:

high pulling forces applied to the actuation cables to overcome the counter-action of the return springs;
rather important translations of the actuation cables;
curved extension of sheaths and actuation cables.

In greater detail it has been found that the wear of sheaths is above all due to the fact that when the extra stroke is carried out, the actuation cables are translated within the sheaths under the action of rather important forces which are, on the other hand, necessary to overcome the high resistance offered by the second return springs.

SUMMARY OF THE INVENTION

It is an object of the present invention to solve the above mentioned problems by eliminating the slidings of the actuation cables within the respective sheaths while the extra stroke is being performed.

The foregoing and still further objects which will become more apparent in the course of the following description are substantially attained by a control device for threading tubes in crochet galloon looms, which device further comprises a number of second return springs each of them having a greater stiffness than the first return springs and acting between a shoulder formed in said fixed support and a locating element fastened to the second end of one of said sheaths, the length of each sheath being greater than the distance between the opposed ends thereof.

BRIEF EXPLANATION OF THE DRAWINGS

Further features and advantages will best be understood from the detailed description of a preferred embodiment of a control device for threading tubes in crochet galloon looms in accordance with the present invention, given hereinafter by way of non-limiting example with reference to the accompanying drawings, in which.

DESCRIPTION OF THE PREFERRED EMBODIMENT

Figure 1:
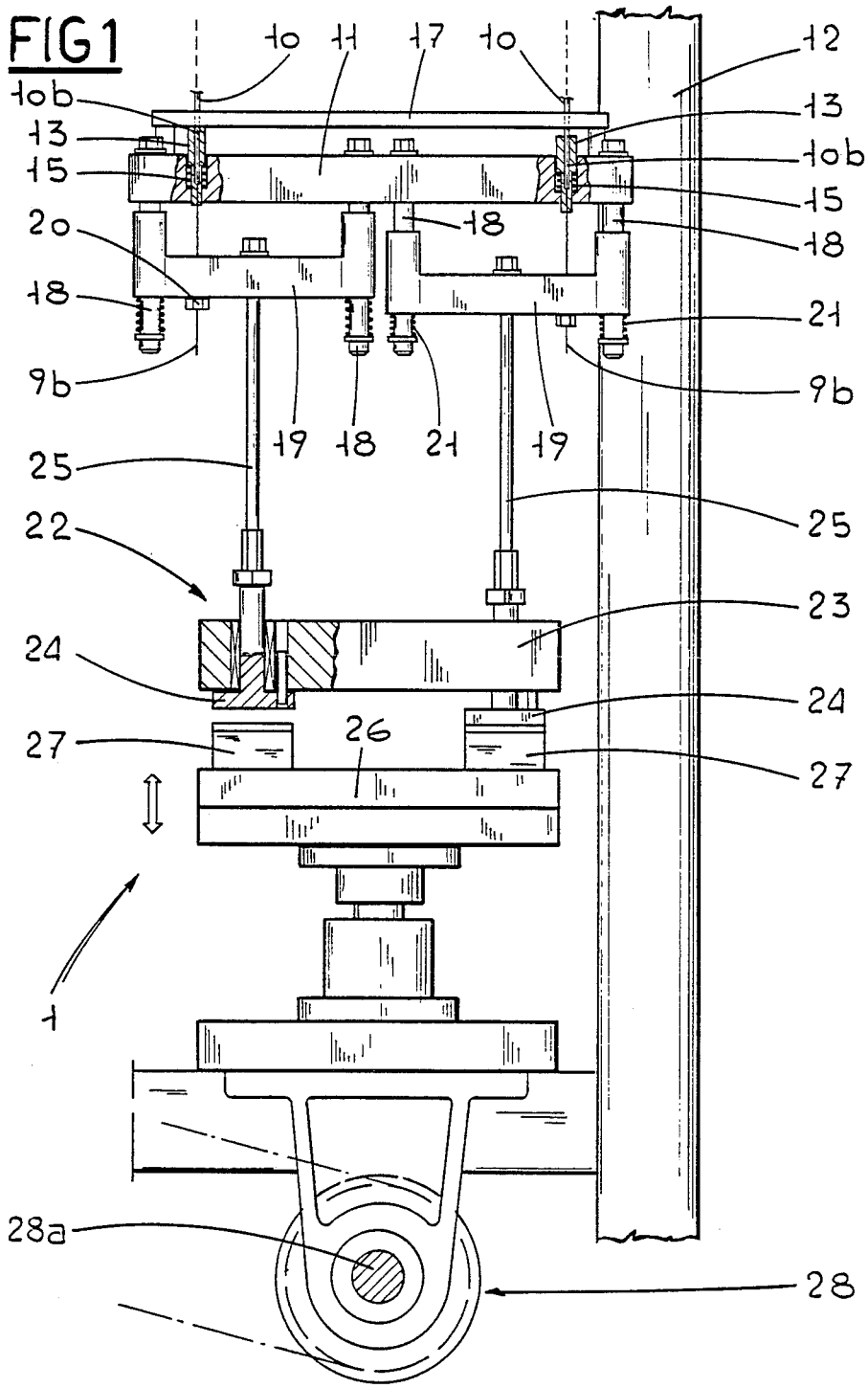
FIG. 1 is a diagrammatic view of the control device in accordance with the invention.

Referring to the drawings, a control device for threading tubes in crochet galloon looms in accordance with the present invention has been globally identified by reference numeral 1.

The device 1 is designed to actuate a number of threading tubes 2 which are conventionally provided in a crochet galloon loom not shown as known per se, and are arranged to slidably engaged a weft yarn. For the sake of clarity, since said threading tubes are all actuated exactly in the same manner, only two of them have been shown in the drawings by way of example.

Each threading tube 2 is fastened to one end of a rod 3 slidably engaged to a support plate 4 in turn secured to a thread guide rail 5. Said rail, in known manner, is actuated by means of combined horizontal and vertical oscillatory movements so that each threading tube 2 may take a semielliptical path on either side of a respective needle not shown.

Figures 1A, 1B:
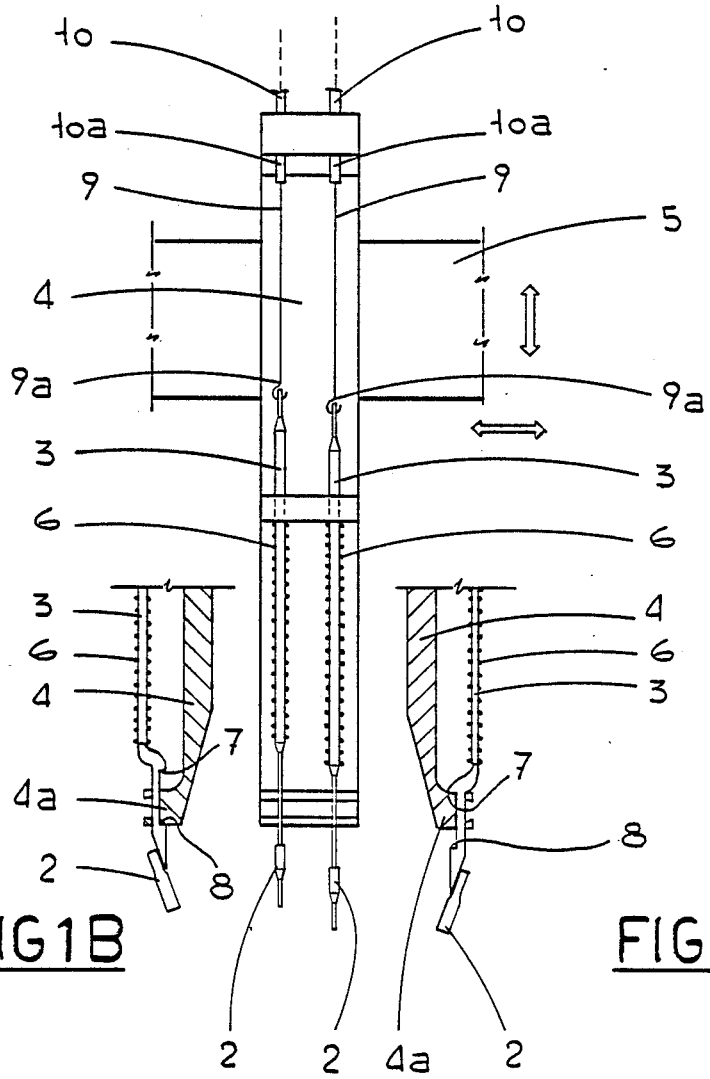
FIG. 1A is a broken sectional view of the support plate for the threading tubes, taken along line A—A in FIG. 1.
FIG. 1B is a broken sectional view of the support plate for the threading tubes, taken along line B—B in FIG. 1.

In a manner known per se, each rod 3 is vertically translatable against the action of first return springs 6 to bring the respective threading tube 2 from a rest position, shown in FIG. 1A, in which the corresponding weft yarn is arranged so as to be engaged by the needle during the working, to a raised position shown in FIG. 1B, in which the weft yarn is not engaged by its respective needle. The positionings of the threading tube 2 in the two above mentioned locations are defined by a first stop shoulder 7 and a second stop shoulder 8 respectively, which are formed in the rod 3 and act in abutment against the edges of a locator means 4*a* exhibited by the support plate 4.

Each rod 3 at its end opposite the respective tube 2 is engaged with one end 9*a* of an actuation cable 9 slidably guided in a sheath 10 a broken portion of which is shown in the drawing. Sheath 10 has one end 10*a* fastened to the support plate 4 so that it is fixedly secured with respect to the thread guide rail 5 and the second end 10*b* engaged with a fixed support 11 integral to a supporting frame 12.

Figure 2:
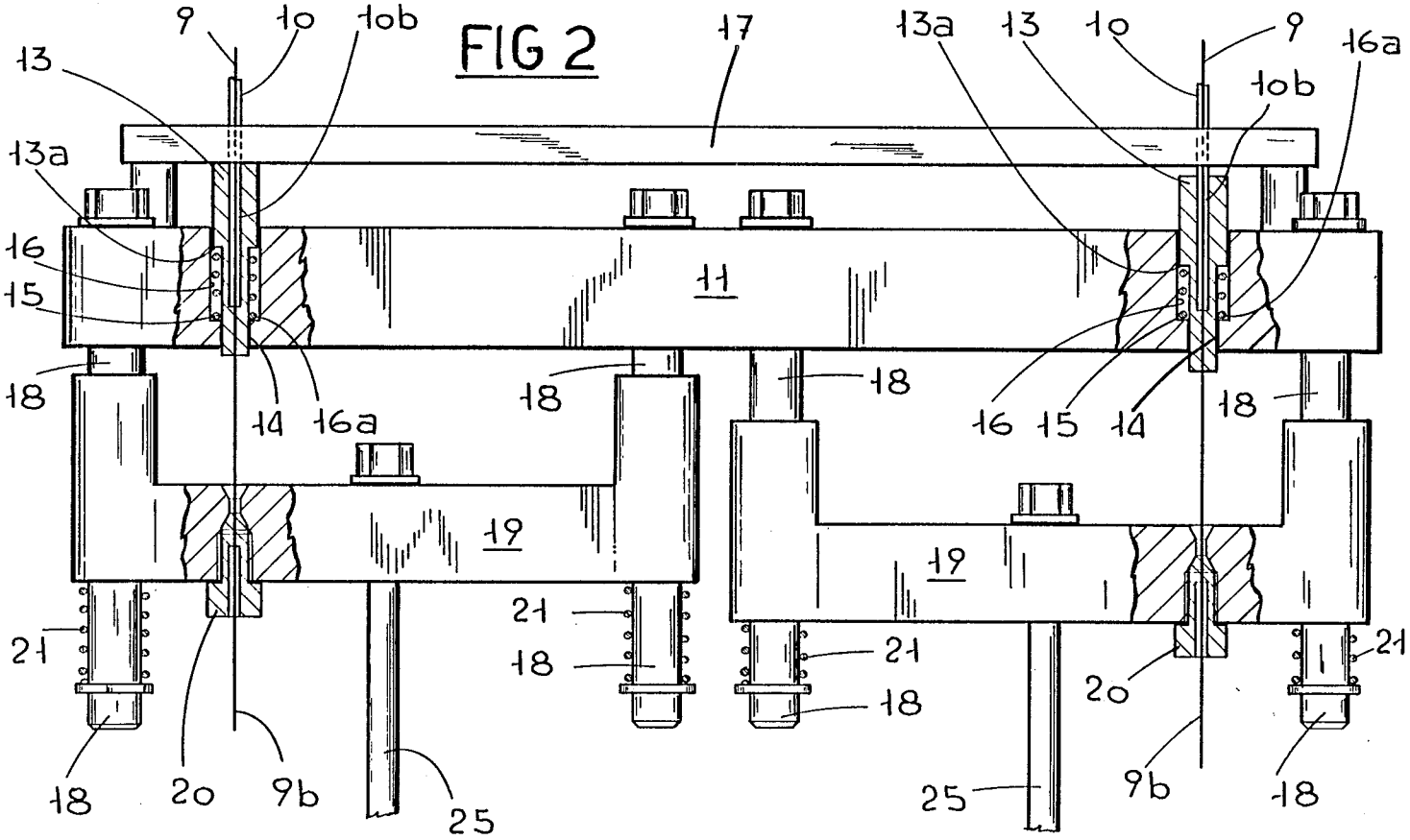
FIG. 2 is an enlarged view of a detail of FIG. 1.

In greater detail, as clearly shown in FIG. 2, the second end 10*b* of each sheath 10 is provided to be fastened to the interior of a locating element 13 slidably engaged in a through hole 14 formed in the fixed support 11 and acted upon by a second return spring 15 the stiffness of which is greater than that of the first return spring 6. The second return spring 15 is accommodated in a housing 16 formed in the fixed support 11 by enlarging the diameter of hole 14 and acts upon a shoulder 16*a* provided at the lower part of said housing 16 and an annular locating ring 13*a* formed on element 13.

Advantageously fastened to the fixed support 11 is a preloading plate 17 slidably passed through by sheaths 10 and acting in abutment upon the locating elements 13 so as to keep the second return springs 15 in a preloading condition.

Also fixedly connected to the fixed support 11 are guide columns 18 slidably engaging control plates 19 disposed on the opposite side with respect to the preloading plate 17. By means of known and conventional fastening members 20 each control plate 19 fixedly engages the second ends 9*b* of one or more actuation cables.

Control plates 19 are individually translatable against the action exerted by counter-springs 21, so that they move away from the fixed support 11 upon command of selective tensioning means globally identified by 22.

Said selective tensioning means comprises a fixed platform 23 in which dish-shaped elements 24 are slidably engaged; said dish-shaped elements are made of magnetizable material and are connected to the control plates 19 by means of tie rods 25. Located below the fixed plateform 23 is a movable platform 26 having a number of electromagnets 27 disposed thereon, each of them facing one of said dish-shaped elements 24. Through a control eccentric diagrammatically shown and conventionally associated with a drive shaft 28*a*, the movable platform 26 receives an oscillatory movement towards the fixed platform 23 and in synchronism with the movements carried out by the different members of the loom during the execution of the working cycle. Electromagnets 27 are in turn individually and selectively energized by known electronic control means not shown.

Each magnet 27, when energized, makes the corresponding dish-shaped element 24 integral thereto in order to drag it along during the lowering and raising movements carried out by the movable platform 26. This situation is clearly shown in FIG. 1 where the movable platform 26 is located at the lower dead center of its stroke and the dish-shaped element 24 to the right is integral to the corresponding magnet 27 and translated downwardly.

The translations imparted to the dish-shaped elements 24 are transmitted, via tie rods 25, to the control plates 19. Under this situation, on each lowering of one of the control plates 19 there is, as a result, the raising of the threading tubes 2 connected thereto through the actuation cables 9. In FIG. 1 it is possible to see that the threading tube 2 disposed to the left and connected to the right-hand control plate 19 is located in its raised position, whereas the other threading tube 2 is in its rest position.

The raising of each threading tube 2 takes place first against the action of the corresponding first return spring 3, as far as no abutment occurs between the second stop shoulder 8 and the edge of the locator means 4*a*. Under this situation the threading tube 2 is disposed in a raised position, but the movable platform 26 must still perform a slight descent translation in order to reach the lower dead center of its stroke. The engagement of the second stop shoulder 8 against the locator means 4*a* prevents the tensioning cable 9 from sliding in the interior of sheath 10 while said additional translation, usually referred to as "extra stroke" is taking place.

As a result, during the execution of said extra stroke by the movable platform 26 the control plate 19 drags along the actuation cable 9 together with the respective sheath 10. The second end 10*b* of sheath 10 is therefore moved downwardly, with reference to the drawings, against the action exerted by the second return spring 15.

Advantageously, under this situation no sliding of the actuation cable 9 within the respective sheath 10 occurs during the execution of said extra stroke.

Thus the present invention attains the intended purposes.

In fact, by eliminating all slidings of the actuation cables within their respective sheaths while said extra stroke is being carried out, there is a great reduction in the sheath wear. In this connection it is to be noted that in the known art the quick wear of sheaths is mostly due to the relative slidings between cables and sheaths which take place during the execution of the extra stroke owing to the high frictions involved as a result of the necessity of applying high pulling forces to the cables in order to overcome the resistance of the second return springs.

Obviously the present invention is susceptible of many modifications and variations, all falling within the scope of the inventive idea characterizing it.

What is claimed is:

1. A control device for threading tubes in crochet galloon looms, comprising:

a thread guide rail provided with an oscillatory motion;

a number of threading tubes oscillatably supported by the thread guide rail and individually translatable with respect to said rail against the action exerted by respective first return springs;

a number of actuation cables each of them having one end connected to one of said threading tubes;

a number of sheaths each slidably engaging one of said actuation cables and having one end fixedly fastened with respect to the thread guide rail and the second end engaged with a fixed support;

a number of control plates each engaging at least one of said actuation cables at a second end thereof and being provided with a to-and-fro translation movement with respect to said fixed support in order to cause, through said actuation cables, the translations of said threading tubes against the action of said first return springs;

control means to selectively translate the control plates in synchronism with the movements of said thread guide rail, which device further comprises a number of second return springs each of them having a greater stiffness than the first return springs and acting between a shoulder formed in said fixed support and a locating element fastened to the second end of one of said sheaths, the length of each sheath being greater than the distance between the opposed ends thereof.

2. The device as claimed in claim 1, wherein each of said second return springs is accommodated in a housing formed in said fixed support and along which said locating element is slidably guided.

3. The device as claimed in claim 1, further comprising at least a preloading plate integral to the fixed support and acting in abutment upon the locating elements to keep said second return springs in a preloading condition.

* * * * *